US006457944B1

(12) United States Patent
Haberlander et al.

(10) Patent No.: US 6,457,944 B1
(45) Date of Patent: Oct. 1, 2002

(54) REGULATION OF THE STROKE FREQUENCY OF A DOSING PUMP

(75) Inventors: Albert Haberlander, Traunstein; Herbert Hunklinger, Ruhpolding, both of (DE)

(73) Assignee: Lang Apparatebau GmbH (Lang), Siegsdorf (DE)

( * ) Notice: Subject to any disclaimer, the term of this patent is extended or adjusted under 35 U.S.C. 154(b) by 0 days.

(21) Appl. No.: 09/700,936

(22) PCT Filed: May 14, 1999

(86) PCT No.: PCT/EP99/03332

§ 371 (c)(1),
(2), (4) Date: Jan. 3, 2001

(87) PCT Pub. No.: WO99/61795

PCT Pub. Date: Dec. 2, 1999

(30) Foreign Application Priority Data

May 23, 1998 (DE) ..... 198 23 156

(51) Int. Cl.[7] ..... F04B 49/06

(52) U.S. Cl. ..... 417/44.1; 417/45; 417/63; 417/53

(58) Field of Search ..... 417/44.1, 45, 63, 417/53

(56) References Cited

U.S. PATENT DOCUMENTS

| | | | | |
|---|---|---|---|---|
| 4,145,161 A | * | 3/1979 | Skinner | 417/22 |
| 4,268,224 A | | 5/1981 | Breuer et al. | 417/32 |
| 4,994,984 A | * | 2/1991 | Massimo | 364/510 |
| 5,673,732 A | | 10/1997 | Kenney et al. | 141/59 |
| 6,121,739 A | * | 9/2000 | Haberlander | 318/362 |

FOREIGN PATENT DOCUMENTS

| | | |
|---|---|---|
| EP | 0774580 A2 | 5/1997 |
| GB | 1444117 | 7/1976 |
| JP | 58288482 | 5/1983 |

OTHER PUBLICATIONS

Gawd, M.; "Drehzahlregelung Von Pumpen Und Luftern Mit Frequenzumrichter", Ikz Haustechnik Sanitar, Heizung Klima Elektro; vol. 49, Jan. 1, 1994; pp. 26–30; XP000195258.

* cited by examiner

*Primary Examiner*—Cheryl J. Tyler
*Assistant Examiner*—Michael K. Gray
(74) *Attorney, Agent, or Firm*—Merchant & Gould P.C.

(57) ABSTRACT

The invention relates to a method for operating a dosing pump, the pump being driven by an asynchronous motor, comprising a drive which converts the motor revolutions into pump strokes of a defined stroke frequency. The pump strokes are comprised of a pump suction stroke and of a pump delivery stroke. Pump strokes are continuously carried out during a dosing phase. The aim of the invention is to provide a solution concerning a dosing pump having an asynchronous motor drive, a frequency converter thereto, and a control unit which interacts therewith in which the dosing behavior is improved during the operation of dosing pumps having an asynchronous motor drive. The invention provides that, with each pump stroke, an electric alternating voltage having a first frequency is applied to the asynchronous motor during the pump suction stroke, and that the same electric alternating voltage having a second frequency which is lower than that during the pump suction stroke is applied to said motor during the pump delivery stroke.

25 Claims, 3 Drawing Sheets

REGULATION OF THE STROKE FREQUENCY OF A DOSING PUMP

BACKGROUND 1.0 Field of the Invention

The invention relates to a method of operating a dosing pump, which is driven by an asynchronous motor, with a pump drive, which converts the motor revolutions into pump strokes consisting of a pump suction cycle and pump pressure cycle and having a defined stroke frequency, wherein continuous pump strokes are carried out during a dosing phase.

2.0 Discussion of the Related Art

Various forms of dosing pumps driven by an electric motor are used for dosing liquids of the most diverse kinds in precise quantities. From a motor power of about 40 watts, the preferred use for such dosing pumps is asynchronous motors supplied by a 230 volt or 115 volt standard operating mains with alternating voltage and alternating current at a mains frequency of 50 or 60 hertz. As long as a mains voltage of 230 volts and the mains frequency of 50 or 60 hertz are applied to the asynchronous motor of these dosing pumps, the asynchronous motors run at a load-dependent, almost constant rotational speed. The motor rotational speed is converted by way of a transmission arrangement into pump strokes performed by a pump element, for example a piston or a diaphragm, producing the respective pump suction and pressure cycles. In the case of a dosing pump driven by an asynchronous motor with 230 volts and 50 or 60 hertz, the maximum stroke frequency, which is predetermined by virtue of the transmission arrangement, is usually between 120 and 180 strokes per minute. Each stroke consists of one suction cycle and one pressure cycle of the pump. Electrical drive control signals, which allow the asynchronous motor to execute a respective stroke of the pump element, for example diaphragm or piston, are supplied to the asynchronous motor by a so-termed water meter or a standard signal transmitter or an internal cycle transmitter. The drive control signals are repeated until the number of strokes carried out for the desired dosing quantity has been performed. A dosing phase of the pump is composed of this number of strokes. A dosing phase is triggered by an electrical start signal supplied to the dosing pump.

In these pumps an alternating voltage with constant frequency is applied during each stroke consisting of a suction cycle and pressure cycle, so that the suction cycle and pressure cycle demand the same period of time. This has the consequence that the product in the dosing duct connected to the pump is conveyed for the time corresponding to the respective pressure cycle, and a standstill phase or "dosing gap" subsequently arises in the dosing duct for the same length of time of the suction cycle before further product is conveyed in the dosing duct by a new pressure cycle. This can lead to an unsatisfactory conveying of product in the dosing duct.

This problem is even more serious in cases where the pump is to dose at a stroke frequency lower than the maximum possible frequency. This occurs when by the asynchronous motor is initially being switched on by means of a drive control signal for a complete stroke consisting of a suction cycle and pressure cycle, but subsequently remains switched off for the duration of a time period necessary for achieving the desired stroke frequency before a new stroke is started by a new drive control signal. An even more unfavourable distribution of the product, which is to be dosed, in the dosing duct results from this so-termed pulse/pause drive control, and so-termed dosing clouds arise at intervals of greater or lesser length.

Another possibility of reducing the stroke frequency consists controlling the asynchronous motor in drive by way of a frequency changer, which supplies to the motor an alternating voltage frequency or alternating current frequency lowered by comparison with the mains frequency of 50 or 60 Hertz. This has the consequence that the motor rotational speed and thus the stroke frequency of the pump are reduced. With the lowered frequency, the time duration of the suction cycle and pressure cycle and thus the stroke frequency are prolonged due to the lower motor rotational speed. The suction cycle and pressure cycle are, however, still of equal length, which means of the same duration in time. The advantage relative to the first method is that due to the prolonged cycle times a pause drive control during which the motor is stopped is no longer necessary for achieving the desired stroke frequency. The pressure cycle is prolonged relative to a pulse/pause drive control at the same stroke frequency, so that a better distribution of the product, which is to be dosed, in the dosing duct is established. However, the suction cycle is also drawn out to the same degree, as a result of which the problem of large gaps without product, which is to be dosed, in the dosing duct still arises.

With the problems of the prior art in mind, an object of the invention is to improve; and dosing performance during operation of dosing pumps with an asynchronous motor drive.

In one embodiment of the invention, this object is met by application, in each pump stroke, to the asynchronous motor of an electrical alternating voltage at higher frequency during the pump suction cycle, and the same electrical alternating voltage at lower frequency relative to that in the pump suction cycle during the pump pressure cycle. The possibility is thus created by the invention of structuring the length or duration in time of the suction cycle and pressure cycle of a stroke to be different. The higher the frequency applied to the asynchronous motor during the suction cycle, the faster the motor turns and the shorter the suction cycle. On the other hand, the lower the frequency, the longer the pressure cycle. It is thus possible to significantly shorten the suction cycle relative to the pressure cycle in its length or duration in time. If a shortest possible suction cycle and a longest possible pressure cycle are desired, the disadvantageous "dosing gaps" in the state of the art no longer arise. The length of the suction cycle is minimized, and thus the time during which no product in a dosing duct is dosed is kept as short as possible, by application of the higher frequency during the suction cycle. The suction cycle is then adjoined by the pressure cycle. This can be regulated in its duration or length in terms of time by application of an appropriate lower alternating voltage frequency to the asynchronous motor, so that a time duration for each stroke consisting of a suction cycle and pressure cycle results, which duration corresponds to the desired stroke frequency. The pressure cycle is, through application of the lower frequency, arranged to be as long in time as possible having regard to the predetermined stroke frequency, i.e. it is maximized in terms of time.

Thus an almost constant dosing of the product in a dosing duct is possible by the invention, with interruption merely by short gaps during the suction cycle. In addition, a further advantage by comparison with pulse/pause control is that due to the regulable frequency during the pressure cycle, the length or duration thereof in time can be set, in particular, independently of the suction cycle and thus the desired stroke frequency can be achieved. As pause times no longer arise during which the asynchronous motor is stopped, the pump drive is mechanically treated in a more gentle manner. By contrast to pulse/pause control it is no longer exposed to any shock loadings, whereby the service life of the drive is increased, particularly in the case of a higher pump output.

The invention thus generally provide that the pump suction cycle and pump pressure cycle are regulated in a different manner with respect to their duration or length in time whereby they are controllably different. This contrasts with the state of the art, in which the suction cycle and pressure cycle are arranged to be of equal length.

It is advantageous if a frequency (typically 50 Hertz or 60 Hertz in the US), above the frequency of a usual 230 or 115 volt standard operating mains is applied as the higher frequency and a frequency below the frequency of a usual 230 or 115 volt standard operating mains is applied as the lower frequency, in one embodiment of the invention.

It is furthermore of advantage in another embodiment of the invention if, for the control and regulation of the length of the suction cycle and pressure cycle, a frequency change is carried out at the start of each pump suction cycle and pump pressure cycle.

In a preferred embodiment of the invention, for achieving a particularly favourable and technically low-cost realization of the method according to the invention, that the settings of a pump element, which produces the pump suction process and pump pressure process of the dosing pump, are detected at the forward dead centre thereof indicative of the start of a pump suction cycle and at the rearward dead centre thereof indicative of the start of a pump pressure cycle by means of position sensors, and that electrical position signals, which are processed into electrical drive control signals triggering the respective frequency change, are transmitted by these position sensors at the respective dead centre.

In a preferred embodiment of the invention, it is particularly advantageous if the position signals are fed to a control unit, and are processed by this unit into the drive control signals triggering the respective frequency change.

It is of advantage to provide a frequency changer for the setting and regulation of the desired frequencies. In a refinement, the invention therefore further provides that the drive control signals are supplied to a frequency changer by which the asynchronous motor is driven by voltages with the respective frequency.

The reaching of the forward and rearward dead centre of the dosing pump element can be detected by reference to the rotor setting of the asynchronous motor or the eccentric setting of a transmission. Accordingly, in another embodiment of the invention the forward and rearward dead centre are detected by reference to the rotor setting of the asynchronous motor or the eccentric setting of a transmission.

In yet another embodiment of the invention, for the triggering of a dosing phase, i.e. a number of pump strokes corresponding to the volume to be dosed by the dosing pump, an electrical start signal triggering the dosing phase is supplied to the control unit when the pump element is positioned in its forward or rearward dead centre.

The pump frequency or stroke frequency is preferably regulated in such a manner that a number of pump strokes corresponding to the volume to be dosed is performed during a dosing phase.

In order to keep the mechanical loading of the dosing pump within manageable limits, and thus the constructional cost within a manageable frame, the invention further provides that the pump strokes are executed at a stroke frequency between 10 and 180 strokes per minute.

It is of advantage both for the mechanical loading of the dosing pump, and for the control and regulation outlay to be expended, if the stroke frequency is constant during a dosing phase, which the invention thus equally proposes.

In a further embodiment the invention, and delete "provides on the one hand that" provides on the one hand that the individual suction cycles during a dosing phase are arranged to be of equal length and on the other hand that the individual pressure cycles during a dosing phase are arranged to be of equal length. This has the advantage of a uniform mechanical loading of the dosing pump.

In another preferred embodiment of the invention, for the regulation of different dosing outputs, that the length of a suction cycle is preset for a maximum stroke frequency, or a 100 percent dosing output, and the length of a pressure cycle is set or regulated to be a complementary value necessary for achieving the respective actual dosing output or stroke frequency. Whereas the length of each suction cycle is designed for the maximum stroke frequency at 100 percent dosing output, and is set by an appropriate frequency supplied to the asynchronous motor, as well as remains constant independently of the respective actual dosing output, the length of each pressure cycle is regulated in dependence on the respective actual dosing output and the stroke frequency connected therewith by supply of a corresponding frequency to the asynchronous motor.

The foregoing object is met in accordance with the invention in such a way that, for a constant operating mains voltage, the frequency changer supplies to the asynchronous motor in each pump stroke alternating current or voltage at higher frequency during a pump suction cycle, and alternating current or voltage at a lower frequency compared with that of the pump suction cycle during a pump pressure cycle.

The method according to the invention can, in this manner, be realized via a dosing pump in a technically relatively simple manner. This dosing pump similarly possesses the foregoing advantages expressed in relation to the method.

In another embodiment of the invention it is similarly provided in the case of the dosing pump that the higher frequency driven voltage lies above the frequency of a usual 230 or 115 volt standard operating mains, and the lower frequency lies below the frequency of a usual 230 or 115 volt standard operating mains.

It is of advantage, and is provided by the invention in one embodiment, for the regulation and drive control of the suction cycle, if the frequency changer changes over to the lower frequency at each rearward dead centre, which represents the start of a pump pressure cycle, of a pump element producing the suction and pressure processes of the dosing pump, and changes over to the higher frequency at each forward dead centre thereof, which represents the start of a pump suction cycle.

In order to trigger the respective frequency changeover, and to be able to realize this in a technically relatively simple manner, it is moreover of advantage if electrical control signals supplied by the control unit to the frequency changer trigger the respective frequency change, which the invention thus equally proposes.

In addition, in another embodiment provided by the invention, it is particularly useful and advantageous for the realization of the frequency change, if the control unit is associated with position sensors detecting the forward and rearward dead centre of the pump element, and supplying electrical position signals to the control unit when the pump element is positioned in each of its dead centres.

In an advantageous embodiment, the invention then proposes that the control unit processes the position signals into the respective drive control signals.

A particularly favourable possibility for detection of the forward and rearward dead centre consists in the position sensors detecting the forward and rearward dead centre of the pump element by reference to the rotor setting of the asynchronous motor or the eccentric setting of a gear, which the invention thus equally proposes.

Moreover, for triggering of a dosing phase the invention provides that an electrical start signal supplied to the control unit triggers a dosing phase.

In a further embodiment the invention provides on the one hand that the individual suction cycles are arranged to be of equal length during a dosing phase and on the other hand that the individual pressure cycles are arranged to be of equal length during a dosing phase.

According to a further development it is of advantage for the regulation and control of the dosing pump if the length of each suction cycle is directed to the maximum number of pump strokes that can be carried out for a 100 percent dosing output and the length of each pressure cycle results as a complementary value necessary for achieving the respective actual dosing output.

The dosing pump has in its individual refinements and developments the same advantages as expressed in the foregoing for the method.

BRIEF DESCRIPTION OF THE DRAWINGS

The invention is explained in more detail in the following by reference to the drawing, in which like items are identified by the same reference designation, wherein:

FIG. 1 shows, in simplified and schematic block circuit diagram illustration, a pump element 1 which is operatively connected with an asynchronous motor 3 by way of a mechanical and transmission connection 2. The transmission connection 2 can be an eccentric transmission. The asynchronous motor 3 has an output of 40 watts or more. The rotational movements of the rotor of the asynchronous motor 3 are converted by means of the mechanical and transmission connection 2 in such a manner that the pump element 1 executes reciprocating movements. The reciprocatingly moved pump element 1 executes a pump suction cycle 16 (see FIGS. 2*a*, 2*b*, 3*a*, and 3*c*) in its away movement (movement in one direction) and a pump pressure cycle 17 in its return movement (movement in an opposite direction) in a dosing pump, which is not illustrated in more detail, and which comprises the elements illustrated in FIG. 1. The pump element 1 can be, for example, a diaphragm or a piston, which triggers or executes the suction cycle 16 and the pressure cycle 17 of the dosing pump by corresponding back and forth movement. The asynchronous motor 3 is connected with an electrical 230 volt or 115 volt standard operating mains 5 with interposition of a frequency changer 4, in this example. The standard operating mains 5 delivers a 230 volt or 115 volt alternating voltage at a frequency of 50 Hertz or 60 Hertz, in this example. This connection is illustrated in FIG. 1 as lines 6 and 7. The mechanical and transmission connection 2 is so designed that the rotational speed accomplished at 230 volts/50/60 hertz by the asynchronous motor 3 is converted into 125 strokes per minute of the pump element 1, wherein each stroke comprises one suction cycle and one pressure cycle. The frequency changer 4 now offers the possibility of regulating and varying the frequency provided by the electric standard operating mains 5, and provides correspondingly changed frequency values to the asynchronous motor 3 by way of the line 7. The mechanical and transmission connection 2 represents a pump drive which, by virtue of its mechanical construction, converts the motor revolutions of the asynchronous motor 3 into reciprocating movements of the pump element 1 at a defined stroke frequency. The stroke frequency is therefore variable solely by variation in the motor revolutions, i.e. the motor rotational speed.

FIG. 1 moreover shows a control unit 8, which similarly stands in operative connection with the standard operating mains 5 by way of a line 9. Electrical drive control signals 10 are supplied by the control unit 8 to the frequency changer 4. In addition, FIG. 1 shows sensors 11, which, as illustrated by the double arrow 12, pick up or detect the rotor setting of the rotor of the asynchronous motor 3 or the eccentric setting of the eccentric transmission, and indicate to the control unit 8 or communicate thereto the rotor setting or the eccentric setting as electrical position signals 13. The electrical position signals 13, fed by the position sensors 11 to the control unit 8, are processed or converted in the control unit 8 into the drive control signals 10 which are supplied to the frequency changer 4 and trigger the respective frequency change. A dosing phase consisting of several cycles 15 (see FIGS. 2*a*, 2*b*, 3*a*, and 3*b*) is triggered in the manner that an electrical start signal illustrated as an arrow 14 is supplied to the control unit 8. This start signal 14 can come from an external signal transmitter, such as for example a water meter, from a standard signal transmitter or also an internal pulse generator of the control unit 8. The asynchronous motor 3 and the mechanical and transmission connection 2 are regulated and designed in such a manner that at the end of each dosing phase, the rotor of the asynchronous motor 3, or the eccentric of the eccentric transmission, adopts a position in which the pump element 1 is disposed at the end of its pressure cycle movement, i.e. in its forward dead centre 18. At the end of its suction cycle movement or at the beginning of its pressure cycle movement, the pump element 1 is disposed in its rearward dead centre 19, which similarly corresponds with a specific rotor setting of the asynchronous motor 3 or an eccentric setting of the transmission. These rotor settings of the asynchronous motor 3 or eccentric settings of the transmission, which settings correspond to the forward and rearward dead centre setting of the pump element 1, are detected by the sensors 11 and supplied to the control unit 8 as electrical position signals 13.

Figure 1:
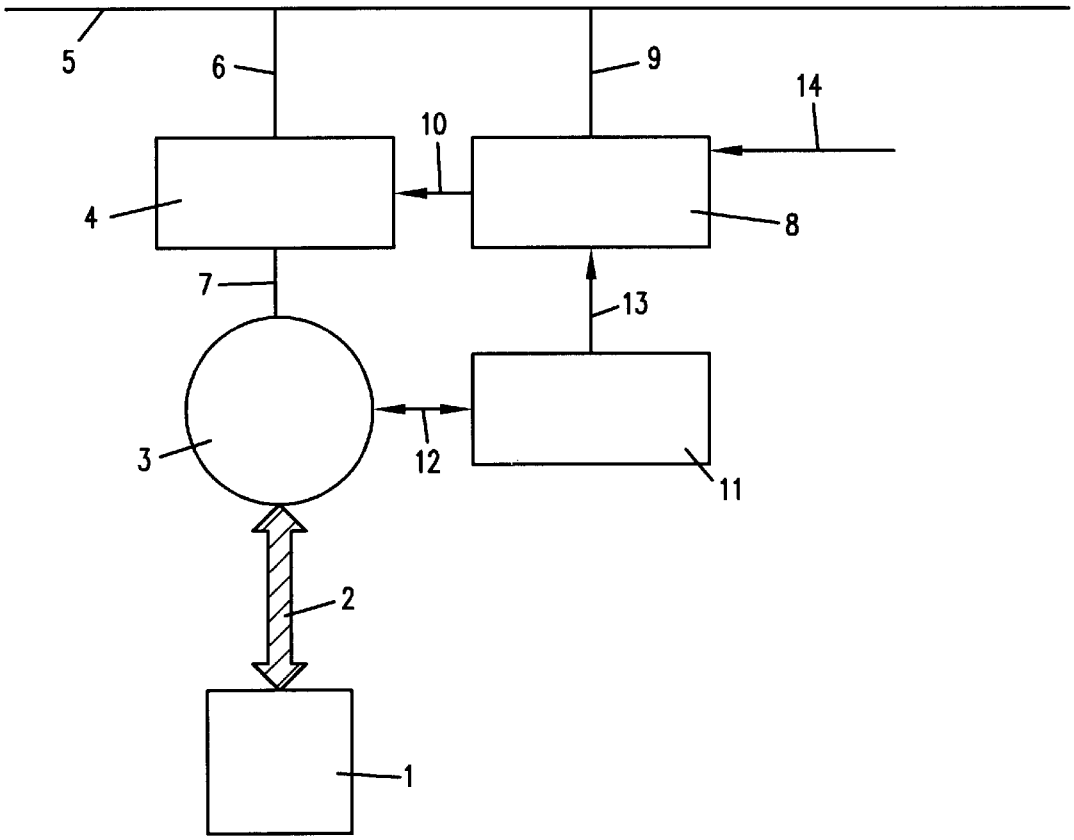
FIG. 1 shows, in simplified and schematic block circuit diagram illustration, components of a dosing pump in accordance with the invention for performance of the method according to the invention.

A dosing phase consisting of a number, which corresponds with the volume to be dosed by the dosing pump, of cycles 15, which each comprise a pump stroke consisting of a suction cycle 16 and pressure cycle 17, is triggered in the manner that a corresponding electrical start signal 14 is supplied to the control unit 8. The control unit 8 then regulates the further performance of the dosing phase. The asynchronous motor 3 is stationary at the start of such a dosing phase, and the pump element 1 is disposed in its forward dead centre 18. This is indicated to the control unit 8 by an electrical position signal 13 of the sensors 11, which in turn cause, through transmission of a drive control signal 10, the frequency changer 4 to supply to the asynchronous motor 3, a 230 or 115 volt operating voltage at a frequency of more than 50/60 hertz. The asynchronous motor 3 now rotates at a high motor rotational speed until the pump element 1 has reached its rearward dead centre 19, and thus a suction cycle 15 is performed. The reaching of the rearward dead centre 19 is in turn detected by the sensors 11 by way of the corresponding rotor setting of the asynchronous motor 3, or of the eccentric transmission and is passed on to the control unit 8 as an electrical position signal 13. Next a fresh drive control signal 10 is inputted to the frequency changer 4, which responds by supplying a 230 or 115 volt operating voltage at a frequency below 50/60 hertz to the asynchronous motor 3. Due to the lower frequency, the asynchronous motor 3 now rotates at a lower rotational speed during the pressure cycle 17, which begins on reaching the rearward dead centre 19, and extends up to attainment of the forward dead centre 18 of the pump element 1 of the dosing pump. The attainment of the forward dead centre 18 of the pump element 1, and thus the end of a pressure cycle 17, is in turn detected by the sensors 11 and passed on to the control unit 8 as an electrical position signal 13. Control unit 8 now imputts a fresh drive control signal 10 to the frequency changer 4, whereupon the frequency change 4 again supplies to the asynchronous motor 3 a 230 or 115 volt operating voltage at a frequency above 50/60 Hertz and in consequence thereof a new dosing cycle 15 with a new suction cycle 16 begins. In accordance with this pattern there now follows in continuous succession as many dosing cycles 15 as until the liquid volume, which is to be dosed during the dosing phase, has been conveyed by the dosing pump. The dosing volume to be dosed is set by the control unit 8, which calculates therefrom, and regulates, the number of cycles 15 corresponding to the dosing phase. Due to the different motor rotational speeds during the suction cycle 16, and during the pressure cycle 17 a different time duration of the suction cycle 16 and pressure cycle 17 results for each cycle 15. In that case, the frequency changer 4, controlled in a regulated manner by the control unit 8, supplies a highest possible frequency to the asynchronous motor 3 during the suction cycle 16 so as to keep the time duration of the suction cycle 16 as short as possible. Subsequently, a lower frequency relative thereto is to be supplied, regulated and controlled by the control unit 8, to the asynchronous motor 3 from the frequency changer 4, which frequency is so calculated that the pressure cycle 17 leads to a stroke frequency, which consists of a suction cycle 16 and pressure cycle 17, and conforms to the number of dosing cycles corresponding to the dosing of the desired volume during a dosing phase. The duration in time of a suction cycle 16 as well as the duration in time of all suction cycles 16, which are to be performed during a dosing phase and during which no dosing takes place, is thus minimized. The duration in time of a pressure cycle 17, as well as all pressure cycles 17, to be performed during a dosing phase is set and regulated in correspondence with the desired stroke frequency and maximized so that during the pressure cycle 17, a continuous and uniform dosing, which is as slow as possible within the scope of the predetermined stroke frequency, is set.

Figure 2A:
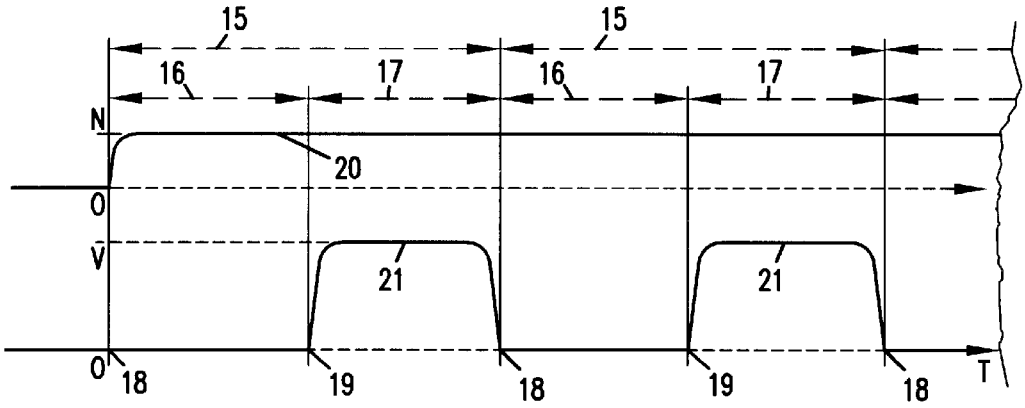
FIG.2A (PRIOR ART)
FIGS. 2*a* and 2*b* show the results of a course of dosing cycles for a prior art dosing pump system (FIG. 2*a*), and the results of a method according to the invention (FIG. 2*b*) for a maximum dosing output.
Figure 2B:
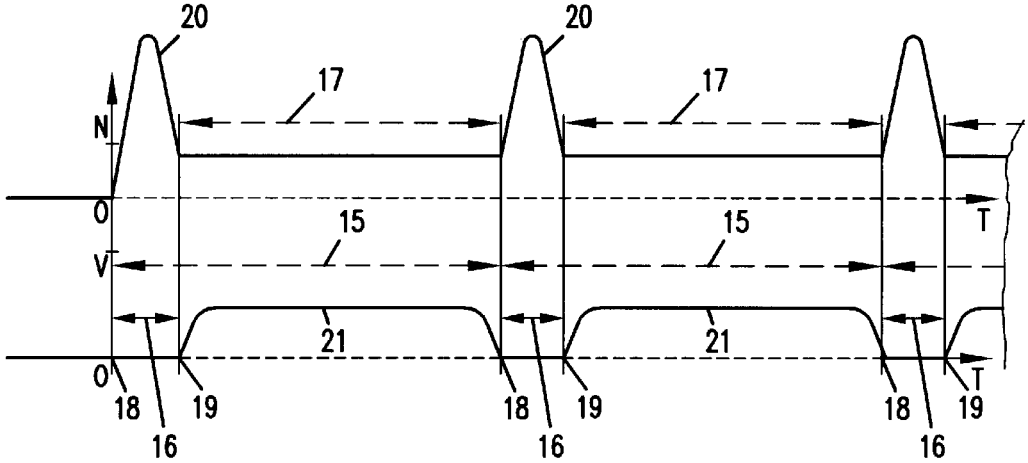
Figure 3A:
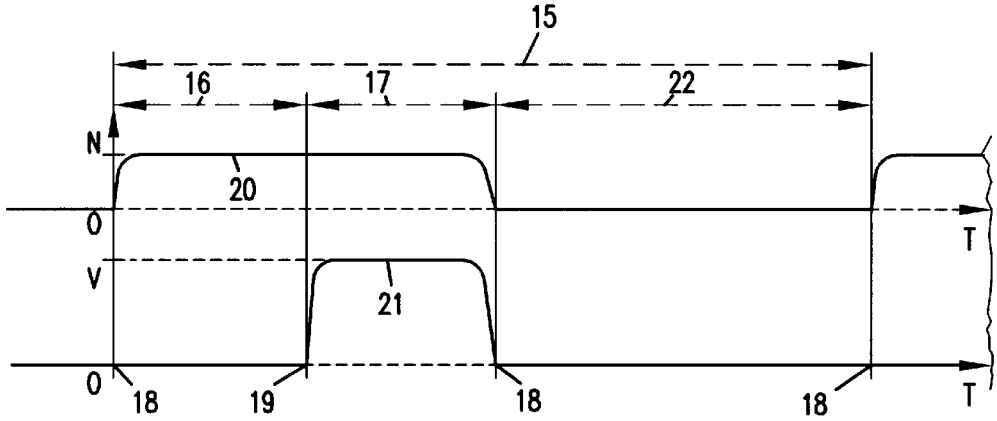
FIG.3A (PRIOR ART)
FIGS. 3*a* and 3*b* show the results of a course over time of dosing cycles for a prior art dosing pump system (FIG. 3*a*), and the results of a method according to the invention (FIG. 3*b*) for a 50 percent dosing output.
Figure 3B:
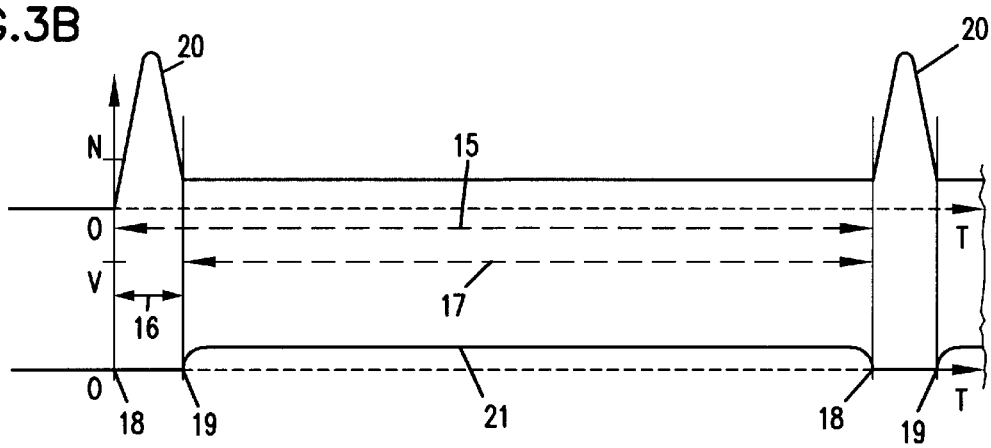

The sequence in time and duration of the suction and pressure cycles 16 and 17, and the comparison thereof with the prior art, are apparent from FIGS. 2*a*, 2*b* and 3*a*, 3*b*. In FIGS. 2*a*, 2*b* and 3*a*, 3*b*, the motor rotational speed n over time t are entered in the upper diagram part and the dosing volume flow V over time t is entered in the lower diagram part. FIGS. 2*a* and 2*b* reproduce the dosing behaviour of a dosing pump in the case of complete utilization of the dosing performance possible with the dosing pump, i.e. at 100 percent dosing output. FIGS. 3*a* and 3*b* reproduce the dosing behaviour at half of capacity, i.e. at 50 percent dosing output, of the dosing pump.

As is apparent from FIGS. 2*a* and 2*b*, in the case of a 100 percent dosing output of the dosing pump, a number of dosing cycles corresponding to the stroke frequency defined by the mechanical and transmission connection 2 takes place in continuous succession, during a dosing phase. Each dosing cycle 15 consists of a suction cycle 16 and a pressure cycle 17, which represent a respective stroke of the dosing pump. Whereas in the state of the art according to FIG. 2*a*, the asynchronous motor 3 is driven from the start of the first suction cycle 16 at a constant motor rotational speed n during the entire number of cycles 15 or the entire dosing phase, with the consequence that a pressure cycle phase 17 of equal length follows in alternation each suction cycle phase 16. In the method according to an embodiment of the invention, a dosing phase starts with a suction cycle 16, during which the driven voltage having a frequency of more than 50/60 hertz is applied to the asynchronous motor 3. The characteristic curves for the motor rotational speed n are provided in each of FIGS. 2*a* and 2*b* with the reference numeral 20. The suction cycles 16 begin each time at the forward dead centre 18 of the pump element 1, and end at the rearward dead centre 19 thereof. On reaching the rearward dead centre 19, the frequency changer changes to a frequency below 50/60 hertz, so that during the pressure cycle 17 which now follows, the asynchronous motor 3—in the case of the method according to the invention, and the dosing pump according to the invention—rotates at a rotational speed n which is smaller relative to that of the suction cycle 16, and a pressure cycle 17 which is longer in time by comparison with the state of the art and by comparison with the suction cycle 16 is executed. Due to the maximum stroke frequency predetermined by the mechanical and transmission connection 2 at maximum motor rotational speed, the length of each dosing cycle 15 in the method according to the invention, and in the dosing pump according to the invention, remains the same, in its duration in time, by comparison with the state of the art. Due to the different motor rotational speeds during the suction cycle 16 and the pressure cycle 17, however, the pressure cycle 17 in the method according to the invention, or the dosing pump according to the invention, is arranged to be significantly longer than the suction cycle 16. On attainment of the forward dead centre 18, the pressure cycle 17 of a dosing cycle 15 is ended, and a new suction cycle 16 of a new dosing cycle 15 begins. During each pressure cycle 17, the same volume is dosed in the method according to the invention as in the method according to the state of the art, which is illustrated by the dosing volume characteristic curve 21 in the part diagrams 2*a* and 2*b*. The area below the lines 21 is the same size in each case. Thus, with the method according to the invention and the dosing pump according to the invention it is succeeded, within the scope of the stroke frequency predetermined by the number of dosing cycles 15, to minimize the duration of each individual suction cycle 16 and to extend, i.e. to maximize, the duration in time of each pressure cycle 17 until reaching the time predetermined for the respective cycle 15 or the respective stroke. It is intended to arrange a suction cycle 16 to be as short as possible, and a pressure cycle 17 to be as long as possible. This leads to an evening out of the dosing of product in a connected dosing duct. It is clearly apparent from FIGS. 2*a* and 2*b* that in the case of the method according to the invention, and dosing pump according to the invention, the suction cycle 16 and pressure cycle 17 are arranged to be significantly different in their extent in time, whereas in the case of the state of the art, by contrast, they are arranged to be of equal length.

The same situation is evident from FIGS. 3*a* and 3*b*, wherein the sole difference here is that in the case of the state of the art a dosing cycle 15 also has a pause time 22, during which the asynchronous motor 3 is stopped in order to thereby be able to match the stroke or cycle frequency of a dosing phase to the desired dosing volume. In the illustrated embodiment, the pause time 22 amounts to 50 percent of the entire time of each dosing cycle 15, so that a 50 percent dosing output of the dosing pump is set here. Such a pause time 22 is no longer necessary for the method according to the invention, and the dosing pump according to the invention, as here the pressure cycle 17 of each cycle 15 is prolonged in its extent in time by corresponding reduction in the motor rotational speed, that means by an appropriately reduced frequency of the operating voltage applied to the asynchronous motor 3, in such a manner that it extends over the time corresponding to the relevant stroke or cycle frequency. The dosing volume dosed during a pressure cycle 17 in the method according to the invention, and the dosing pump according to the invention, is also here the same as in the case of the state of the art, which is evident by the respective areas of equal size below the dosing volume characteristic curve 21. The advantage of this method procedure according to the invention and the dosing pump according to the invention relative to the state of the art, is that in this case the motor 3 continuously rotates and the mechanical and transmission connection 2 is thereby treated significantly more gently, as it is not exposed to force shocks in the repeated starting and stopping of the motor. Moreover, due to the fact that a pause time no longer occurs in the method according to the invention, and the dosing pump according to the invention, there is a continuous dosing with a significantly improved distribution of the product, which is to be dosed, in the dosing duct. Appreciable "dosing gaps" no longer arise.

During a dosing cycle 15, a stroke which extends over the entire duration in time thereof, and consists of a suction cycle 16 and a pressure cycle 17, is executed so that as in the state of the art, the stroke frequency corresponds to the frequency of the cycles 15, but a stroke is performed continuously over a cycle 15 and the next cycle 15 or stroke follows continuously.

The method according to the invention, and the dosing pump according to the invention, are so designed with respect to their mechanical form and control and regulating devices 2, 3, 4 and 8 that pump strokes can be executed at a stroke frequency between 10 and 180 strokes per minute. In that case, in particular, the stroke frequency during a dosing phase consisting of several dosing cycles 15 shall be constant.

The duration of a suction cycle 16 is determined by the maximum stroke frequency, which is preferably selectively settable at the control unit 8, i.e. the maximum number of strokes performable during a unit of time at a 100 percent dosing output, and remains constant during a dosing phase. The duration of a pressure cycle 17 is yielded as a complementary value necessary for achieving the respective actual dosing output or stroke frequency. The duration of each pressure cycle 17 is also constant during a dosing phase. The stroke rate for a respectively desired dosing output is set in the manner that the duration of each pressure cycle 17 is matched to the respective dosing output or the corresponding stroke rate, i.e. is appropriately prolonged so that the reduced number of strokes corresponding to the desired dosing output is thereby performed. This regulation is carried out by the control unit 8 and/or the frequency changer 4, which supplies to the asynchronous motor 3 during each suction cycle 16 and pressure cycle 17, a frequency necessary for attaining the required stroke frequency, and thus for attaining the required duration of the suction cycle 16 and pressure cycle 17. This manner of procedure is evident from a comparison of FIGS. 2*b* and 3*b*. Whereas the suction cycles 16 are arranged to each be of equal length, the pressure cycle 17 in FIG. 3*b* is prolonged in such a manner that, in the case of the 50 percent dosing output thereof, a dosing cycle 15 is set which corresponds in its duration in time to two dosing cycles 15 of FIG. 2*b*.

Liquids of the most diverse kind can be dosed by the dosing pump.

Although various embodiments of the invention have been shown and described they are not meant to be limiting. Those of skill in the art may recognize certain modifications to these embodiments, which modifications are meant to be covered by the spirit and scope of the appended claims.

What is claimed is:

1. A method for operating a dosing pump driven by an asynchronous motor, with a pump drive converting the motor revolutions into pump strokes consisting of a pump suction cycle and pump pressure cycle, and having a defined stroke frequency, wherein continuous pump strokes are performed during a dosing phase, comprising steps of applying in each pump stroke an electrical alternating voltage at a first frequency to the asynchronous motor during the pump suction cycle, and applying during the same pressure cycle the same electrical alternating voltage to the asynchronous motor at a second frequency which is lower relative to that in the pump suction cycle.

2. The method according to claim 1, wherein said first frequency is higher than the line frequency of typical 230 volt or 115 volt standard operating voltage service is applied as the higher frequency, and said second frequency lower than the line frequency of a typical 230 volt or 115 volt operating voltage service is applied as the lower frequency.

3. The method according to claim 1, wherein a frequency change of the alternating voltage is carried out at each start of a pump suction cycle, and of a pump pressure cycle.

4. The method according to claim 1, wherein the settings of a pump element, which produces the pump suction process and the pump pressure process of the dosing pump, of the pump drive are detected in the forward dead center thereof indicative of the start of a pump suction cycle, and in the rearward dead center thereof indicative of the start of a pump pressure cycle, and electrical position signals, which are processed into electrical drive control signals triggering the respective frequency change, are produced by these position sensors in each of the dead centers.

5. The method according to claim 4, wherein the position signals are supplied to a control unit and are processed buy said unit into the drive control signals triggering the respective frequency change.

6. The method according to claim 4, wherein the drive control signals are supplied to a frequency changer by which the asynchronous motor is supplied with drive voltages having the respective frequency.

7. The method according to claim 4, wherein the forward and rearward dead centers are detected by reference to the rotor setting of the asynchronous motor or the eccentric setting of a transmission.

8. The method according to claim 4, wherein an electrical start signal triggering the dosing phase is supplied to the control unit when the pump element is positioned in its forward or rearward dead center.

9. The method according to claim 1 wherein a number of pump strokes corresponding to the volume to be dosed is carried out during a dosing phase.

10. The method according to claim 1 wherein pump strokes with a stroke frequency between 10 and 180 strokes per minute are provided.

11. The method according to claim 1, wherein the strokes have a stroke frequency that is constant during a dosing phase.

12. The method according to claim 1, wherein individual suction cycles are arranged to be of equal length during a dosing phase.

13. The method according to claim 1, wherein individual pressure cycles are arranged to be of equal length during a dosing phase.

14. The method according to claim 1, wherein the length of the suction cycle is predetermined for a maximum stroke frequency or a 100 percent dosing outputs and the length of a pressure cycle is set or regulated as a complementary value necessary to achieve the respective actual dosing output or stroke frequency.

15. A dosing pump includes an asynchronous motor drive, a frequency changer associated therewith, and a control unit operatively connected thereto, wherein for a constant operating line voltage, the frequency changer feeds to the asynchronous motor in each pump stroke an alternating voltage or current of relatively higher frequency during a pump suction cycle, and an alternating voltage or current at lower frequency relative to that in the pump suction cycle, during a pump pressure cycle.

16. A dosing pump according to claim 15, wherein the higher frequency lies above the frequency of a typical standard operating line voltage. and the lower frequency lies below the frequency of the typical standard operating line voltage.

17. A dosing pump according to claim 15, wherein the frequency changer changes to the lower frequency in each rearward dead center, which represents the start of a pump pressure cycle, of a pump element producing the suction process and pressure process of the dosing pumps and changes to the higher frequency in each forward dead center, which represents the start of a pump suction cycle, thereof.

18. A dosing pump according to claim 15, wherein electrical control signals supplied by the control unit to the frequency changer trigger the respective frequency change.

19. A dosing pump according to claim 17, wherein the control unit is associated with position sensors which detect the forward and rearward dead centers of the pump element, and feed electrical position signals to the control unit when the pump element is positioned in each dead center thereof.

20. A dosing pump according to claim 19, wherein the control unit processes the position signals into the respective drive control signals.

21. A dosing pump according to claim 19, wherein the position sensors detect the forward and rearward dead centers of the pump element by reference to the rotor setting of the asynchronous motor or the eccentric setting of a transmission.

22. A dosing pump according to claim 15 wherein an electrical start signal supplied to the control unit triggers a dosing phase.

23. A dosing pump according to claim 15, wherein individual suction cycles are arranged to be of equal length during a dosing phase.

24. A dosing pump according to claim 15, wherein individual pressure cycles are arranged to be of equal length during a dosing phase.

25. A dosing pump according to claim 15, wherein the length of each suction cycle is directed to the maximum performable number of pump strokes for a 100 percent dosing output, and the length of each pressure cycle results as the complementary value necessary for achieving the respective actual dosing output.

* * * * *